United States Patent [19]

Itey

[11] Patent Number: 5,031,824

[45] Date of Patent: Jul. 16, 1991

[54] PACKING BOX, IN PARTICULAR FOR PASTRIES OR CAKES, PREPARED FROM A CUT-OUT AND GROOVED BLANK

[76] Inventor: Frederic Itey, 16, rue des Graviers, 91300 Massy

[21] Appl. No.: 426,328

[22] Filed: Oct. 24, 1989

[30] Foreign Application Priority Data

Oct. 26, 1988 [FR] France ..... 88 13968

[51] Int. Cl.[5] ..... B65D 5/24

[52] U.S. Cl. ..... 229/110; 229/117.15; 229/117.24; 229/186; 229/906

[58] Field of Search ..... 229/109, 110, 155, 156, 229/157, 186, 117.15, 117.24, 906

[56] References Cited

U.S. PATENT DOCUMENTS

| | | | |
|---|---|---|---|
| 886,058 | 4/1908 | Hollett | 229/155 |
| 1,760,106 | 5/1930 | Beach | 229/155 |
| 2,162,235 | 6/1939 | Vaughn | 229/117.24 |
| 2,891,715 | 6/1959 | Vineberg | 229/117.24 |
| 2,916,195 | 12/1959 | Gatward | 229/155 |
| 3,377,015 | 4/1968 | Moreno | 229/110 |

FOREIGN PATENT DOCUMENTS

| | | | |
|---|---|---|---|
| 467840 | 6/1914 | France | 229/155 |
| 778456 | 3/1935 | France | 229/117.15 |
| 970747 | 1/1951 | France | 229/186 |
| 1113570 | 3/1956 | France | 229/155 |
| 459529 | 4/1951 | Italy | 229/157 |
| 226586 | 7/1943 | Switzerland | 229/155 |
| 263454 | 12/1949 | Switzerland | 229/117.15 |
| 10623 | of 1911 | United Kingdom | 229/117.15 |
| 407566 | 3/1934 | United Kingdom | 229/117.24 |

*Primary Examiner*—Gary E. Elkins
*Attorney, Agent, or Firm*—Hughes & Multer

[57] ABSTRACT

A packing box, in particular for pastries or cakes, is prepared from a cut-out and grooved blank.

The box is characterized in that: each flap (201–206; 401–404) is formed from a lower part (201A–206A; 401A–404A) and a tab (201B–206B; 401B–404B) and each lower part (201A–206A; 401A–406A) is bordered over at least part of its length and on at least one of its sides by a strengthening strip (201E, 201F–206E, 206F, 401E–401F) connected to the base by a fold line. The homologous strengthening strips of the two adjacent flaps are joined by a fold line (300, 501, 502, 503, 504) and when the flaps are raised, the two strengthening strips project into the space of the box and approach the fold lines so as to form a ridge between the two flaps.

The invention relates to cardboard boxes.

14 Claims, 5 Drawing Sheets

PACKING BOX, IN PARTICULAR FOR PASTRIES OR CAKES, PREPARED FROM A CUT-OUT AND GROOVED BLANK

The present invention relates to a box for holding and carrying products such as pastries, cakes or other products requiring opened-out presentation.

Numerous types of folding boxes are known which are manufactured by cardboard producers and are flattened for delivery to the user. In particular the conventional patisserie boxes are known. These boxes consist of a complete component formed of a base bordered by three edges; the rear edge comprises the cover. The edges of the base and the edges of the cover are folded along fold lines in order to flatten the box.

The patisserie boxes which have been used for decades have the advantage that they can be flattened and folded up to receive products to be packaged at the time of sale. Thanks to their walls and the sticking of the walls on the different sides to one another in the opened-out state, these boxes are sufficiently rigid for a ribbon to be passed around them and to be carried by holding the ribbon.

However, these boxes have a certain number of disadvantages, the most serious of which is that of the height of the edges or even the existence of edges on the base. To insert the products, in particular fragile products such as pastries, into a box of this type, they must be held with tongs and slid in from above, since the edges prevent them from being inserted flat.

The same disadvantage occurs when the pastries are removed from the box.

In some cases, when the box is completely filled with products placed side by side it is difficult to remove these products from the box. The only solution is to cut the edges so that the product can be reached more easily and they can be placed on a tray.

The above-described disadvantage is even more serious in the case of products which are very fragile but of dimensions larger than simple pieces of pastry, such as yule logs, for example. The insertion of logs into a box is extremely awkward if the decoration on the log is not to be damaged. As for other products, the removal of the log is relatively awkward and in most cases the only solution to make removal easier is to cut the box around the base.

The disadvantage of this method of packaging is that it does not benefit from the appearance of the box to enhance display. On the contrary, since the box cannot be used to display the products, no particular effort has been made to improve the aesthetic appearance of the box so that it can contribute to the presentation of the product.

There also exist a certain number of other products which might benefit from a more pleasant appearance, which would promote their distribution.

Thus certain floral decorations or certain flowers such as orchids are presented in boxes with walls made of transparent paper. They could be easier to display in boxes which close or open over the products in the manner of an envelope, whilst protecting them effectively during transportation.

Products also exist which would gain from being displayed in the opened-out position, such as necklaces, for example. For expensive products there are of course cases which display the necklace in the open position on a support. However, less costly necklaces or the like are presented in small bags.

The aim of the present invention is to produce a box for holding and carrying very different products, such as pastries, cakes or even products which it is desirable to display in the opened-out state; the box not being bulky to store and transport in the folded state, and enabling the product to be packaged to be enveloped without the risk of its being crushed, either as a result of deformation of the edges or by sagging of the box.

To this end, the invention relates to a box formed from a blank of cardboard or similar material cut out and grooved along fold lines; the box comprising a base bordered by flaps articulated on the base in order that they can be raised and envelope the product placed in the box, this box being characterised in that:

each flap is formed from a lower part and a tab;

the lower part is bordered over at least part of its length and on at least one of its edges by a strengthening strip connected to the lower part by a fold line and the homologous strengthening strips of the two adjacent flaps being joined by a fold line when the flaps are raised, the two strengthening strips projecting into the space of the box and approaching the fold lines to form a ridge between the two flaps.

Owing to the strengthening strips associated with each flap over the height of the lower part, a box which is rigid over the entire height of the bases is obtained. This box can neither sag nor be deformed in the transverse direction, that is its edges cannot even incline.

Products, in particular fragile products contained in the box, are therefore protected by the rigid shape.

Furthermore, the ridges formed by the strengthening strips and the lower parts of each flap are joined in a precise and neat manner at the junction of two flaps which prevents the flaps gaping with respect to one another and prevents the folded or curved tabs in the upper part of the package causing the flaps to incline and sag.

In addition, owing to the joining of the lower part of adjacent strengthening strips—the join being along a fold line—the two adjacent flaps are made integral without the packaging being prevented from being laid flat as a result of this fact that the flaps can be made integral.

Thanks to the fold lines in the base, the package can be folded in a form which is not at all bulky, irrespective of the number of sides of the polygon forming the base. Given irregular polygons, such as rectangles for example, can be folded in this manner.

The laying flat of the blank facilitates the placing of the products on the base and their removal. When the box is opened, the flaps open out in the manner of flower petals, which enhances the appearance and in certain cases allows the products to be left in the packaging open in this manner.

For this purpose, it may be advantageous to leave the blanks in the rough state on their lower face but to decorate them.

The present invention will be described in greater detail by means of the attached drawings, wherein:

FIG. 1 shows a first embodiment of a box according to the invention, this box being shown in the closed state.

Figure 1:
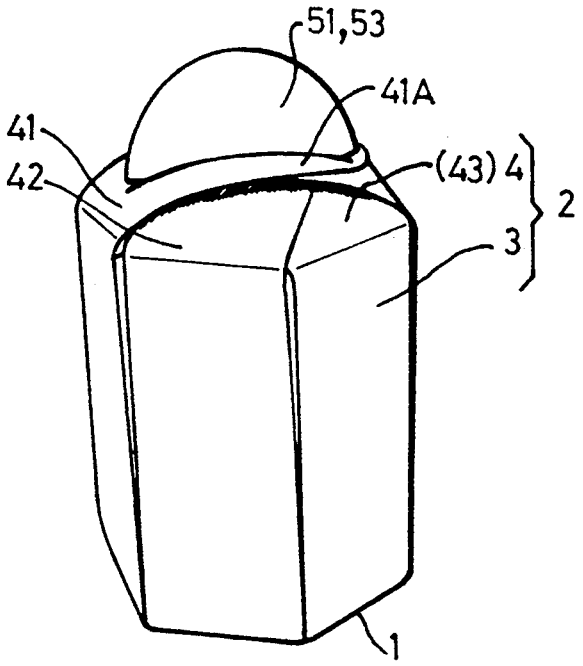
FIG. 1 is a perspective view of a first embodiment of a box according to the invention.

In accordance with the invention, this box is formed from a cut-out blank consisting of a polygonal base 1 bordered by flaps 2 forming the edges of the box. Each flap 2 consists of a lower part 3 and a tab 4.

The tabs 4 of the various flaps are folded up whilst the lower parts 3 stay flat and perpendicular to the base for reasons explained below.

The tabs 4 comprises closure means. Thus the tab 41 is provided with a slot 51 and the other tabs 42, 43 are provided with rounded tongues 52, 53 which are slid through the slot 41A and form the handle for the box. These tongues may be cut out to form a sort of hoop.

Figure 2:
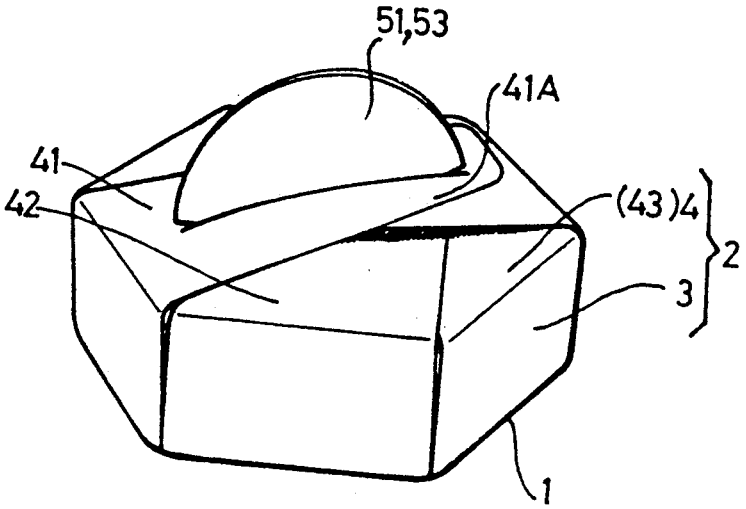
FIG. 2 is a perspective view of a second embodiment of a box according to the invention.

The embodiment in FIG. 2 is similar to the one in FIG. 1 in that it is a box with a polygonal (hexagonal) cross-section. The handle is also the same. Only the height is not so great and the shape of the base larger.

As the components of the box in FIG. 2 are identical or similar to those in FIG. 1, they bear the same reference numbers and their description will not be repeated.

These boxes are intended for holding and carrying products such as parties or cakes which are arranged on the base, then the box is closed envelopping the contents.

These boxes may likewise be used to package products requiring them to be displayed in the opened-out state, such as necklaces or articles of jewellery which are placed on a support, which is itself placed on the base of a box of this type, instead of being placed in a case.

Figure 3:
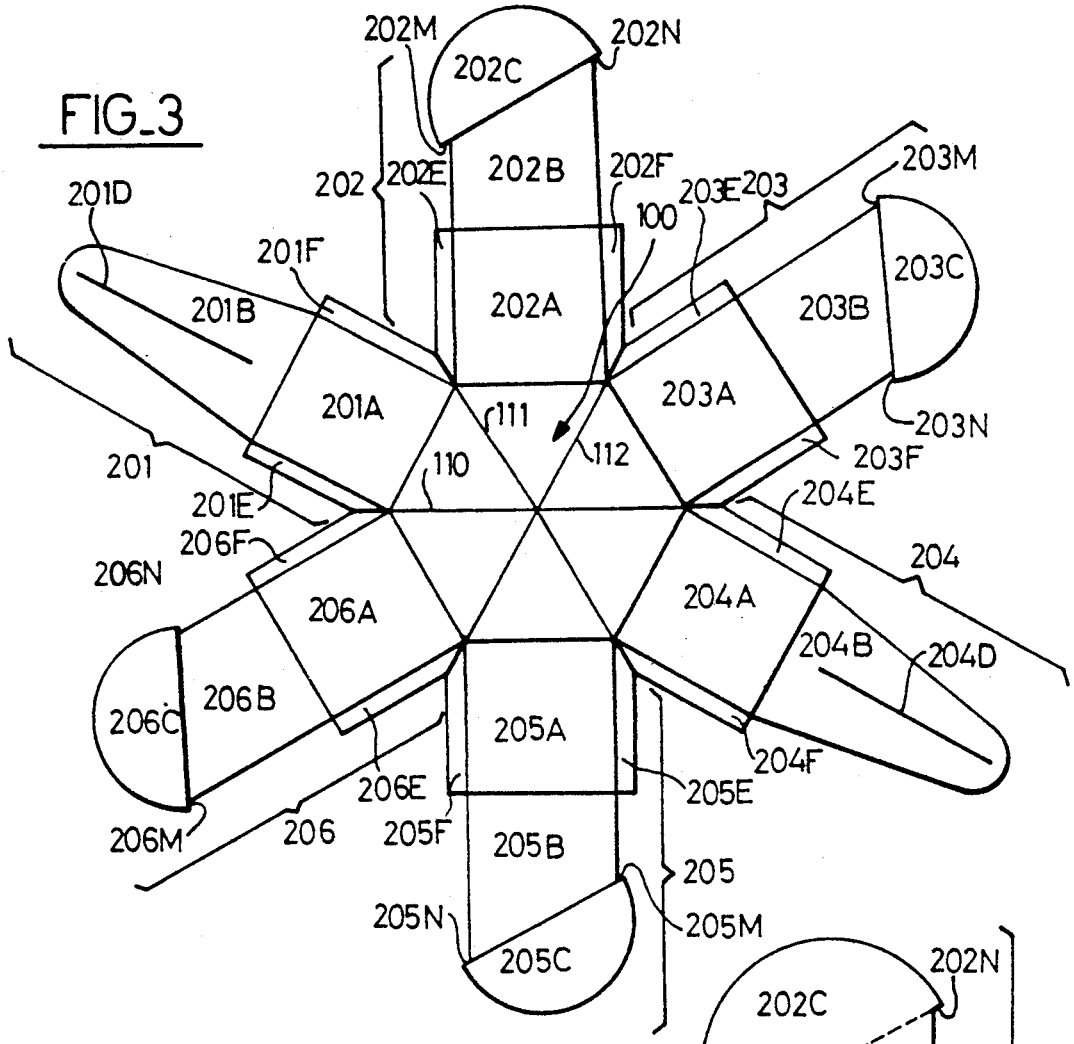
FIG. 3 is an opened-out view of the cut-out blank used to form a box with a hexagonal cross-section as in the first and second embodiments.

FIG. 3 shows the shape of a blank used to produce a box with a hexagonal cross-section, as shown in FIG. 1 or 2.

In accordance with the invention, this cut-out and grooved blank comprises a base 100 bordered by flaps 201, 202, 203, 204, 205, 206. Each flap is formed by a lower part 201A, 202A, 203A, 204A, 205A, and 206A and a tab 201B, 202B, 203B, 204B, 205B, 206B. The tabs 201B . . . 206B are provided with connecting means consisting int he case of tabs 201B, 204B of a slot 201D, 204D and, in the case of tabs 202B, 203B, 205B, 206B, the tab ends in a tongue 202C, 203C, 205C, 206C with a rounded shape, for example a semi-circle and forming shoulders or fastening means 202M, 202N, 203M, 203N, 205M, 205N, 206M, 206N, such that, when the tongue is slid into the slots 201D, 204D, it is fastened by the shoulders.

Figure 4:
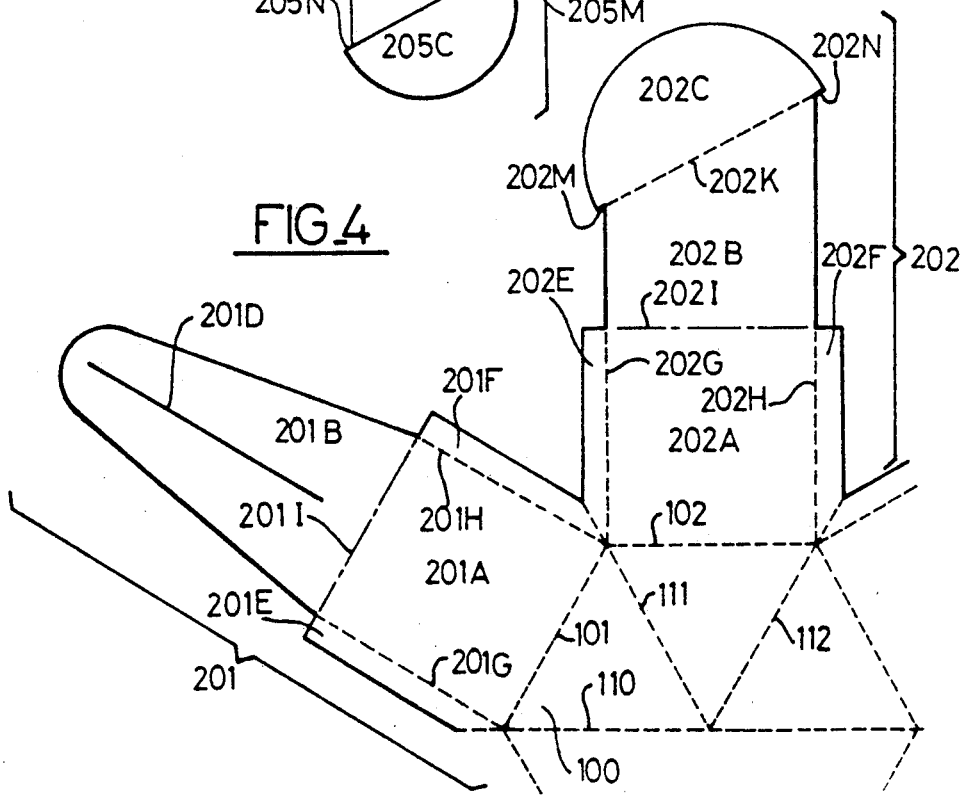
FIG. 4 is a partial view of the cut-out blank in FIG. 3.

FIG. 4 is a detailed view on an enlarged scale of part of FIG. 3 used to described the present invention as applied to this example.

In accordance with FIG. 4, the lower parts 201A, 202A, etc. are bordered on each side by a strengthening strip 201E, 201F, 202E, 202F. These strengthening strips are connected to the base by a fold line 201G, 201H, 202G, 202H and the adjacent strengthening strips 201F, 202E belonging to two adjacent lower parts 201A, 202A are connected by a fold line 300.

The flaps 201, 202 etc. are connected to the base 100 by fold liens 101, 102, etc.

Finally, in one embodiment the tabs are connected to the lower part without there being any fold line as the tabs are merely curved beyond their respective lower part (see FIG. 1 and FIG. 2). In a variant, there is provided a line forming the beginning of a fold represented by broken lines (lines 201I and 202I).

Finally, in the case of the tab 202C, the fold line 202K is inclined across the flap 202 so that the line 202K corresponding to the passage of the tab 202 through the slot 201C is substantially horizontal (see FIGS. 1 and 2) when the box is closed.

The Figures also show the two stops 202N and 202M which hold the tongue 202C beyond the slot 201C.

FIG. 4 also shows the base 100 with the shape of a regular polygon, provided with fold lines 110, 111, 112 which pass through the center (see also FIG. 3) and enable the blank to be folded flat either about a single fold line 110 or about two or three fold lines 110, 111, 112; in this position the flaps and corresponding sections of the base are superimposed. This reduces the bulkiness of the blank.

Figure 5:
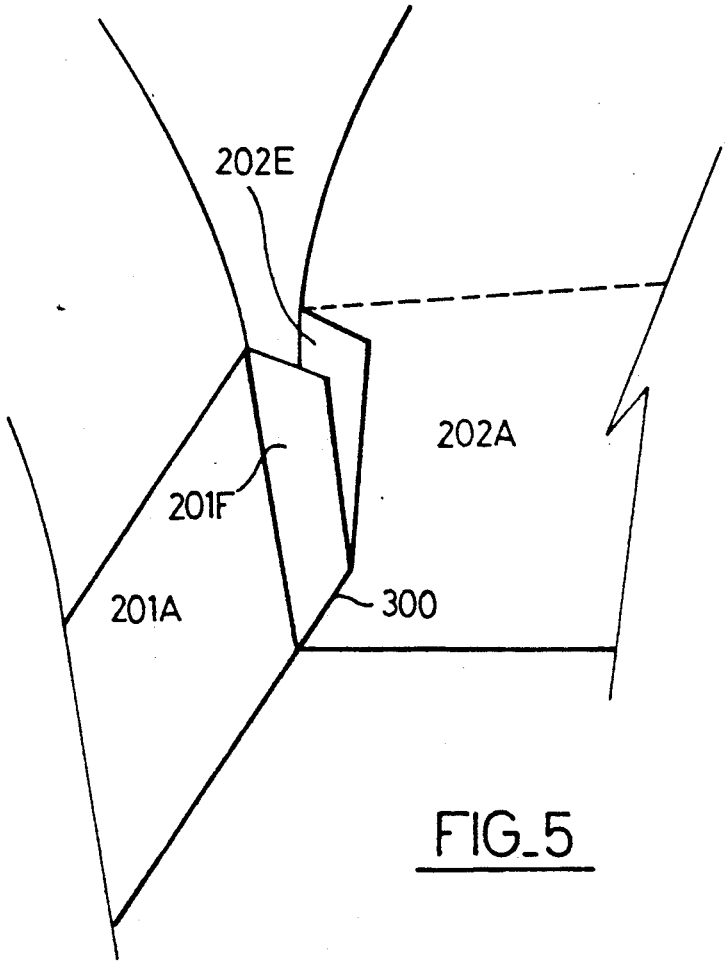
FIG. 5 is a detailed view of the join between two flaps in the raised state.

FIG. 5 shows the section of the box shown in plan view in FIG. 4, in the folded position. This Figure shows in particular the shape adopted by the associated strengthening strips 201F, 202E which are articulated about fold lines 201H, 203E and line 300 such that they come inside the volume of the package. In this position illustrated, which is slightly open, the strengthening strips 201F, 202E reinforce the ridge at the join of the two lower parts 201A, 202A.

Figure 6:
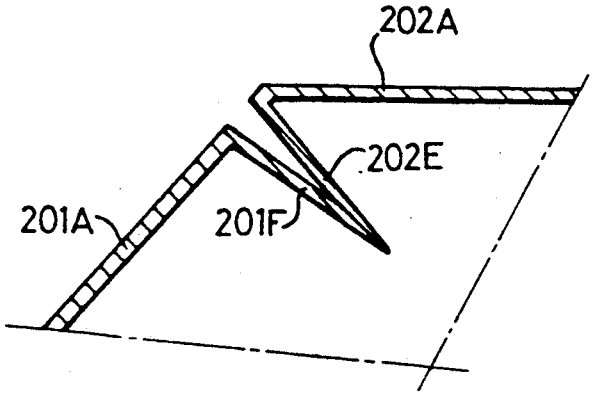
FIG. 6 is a schematic cutaway view of FIG. 5.

FIG. 6 shows in cutaway view the shape taken by the strengthening strips 201F, 202F.

Figure 7:
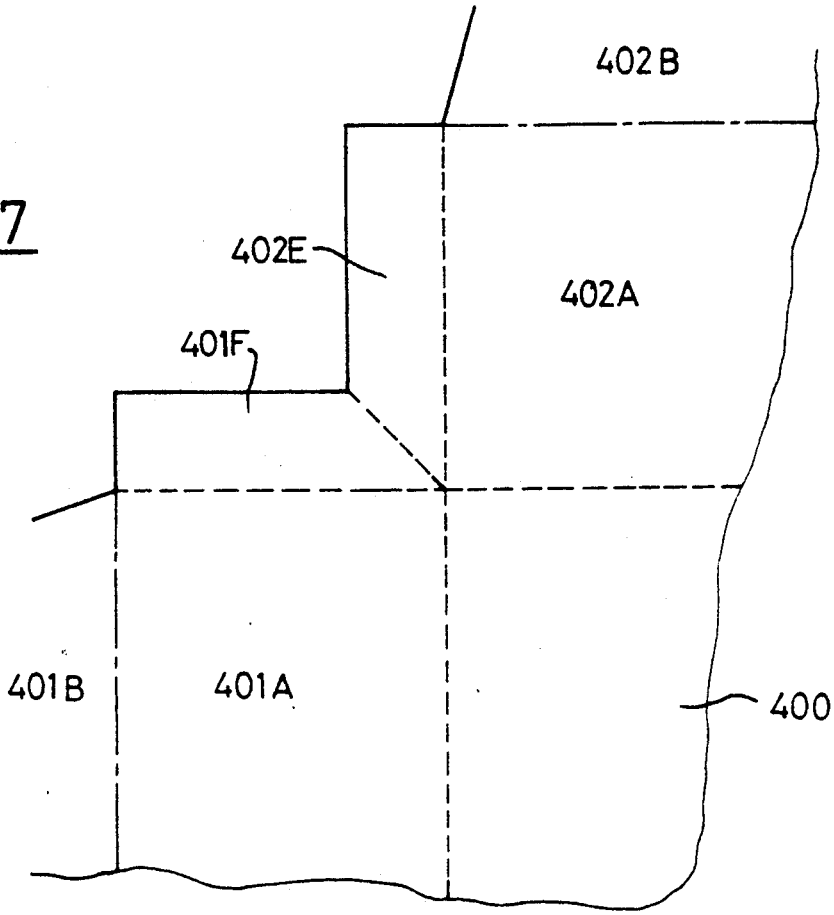
FIG. 7 is a detailed view similar to FIG. 4 corresponding to a box with a square or rectangular cross-section.
Figure 8:
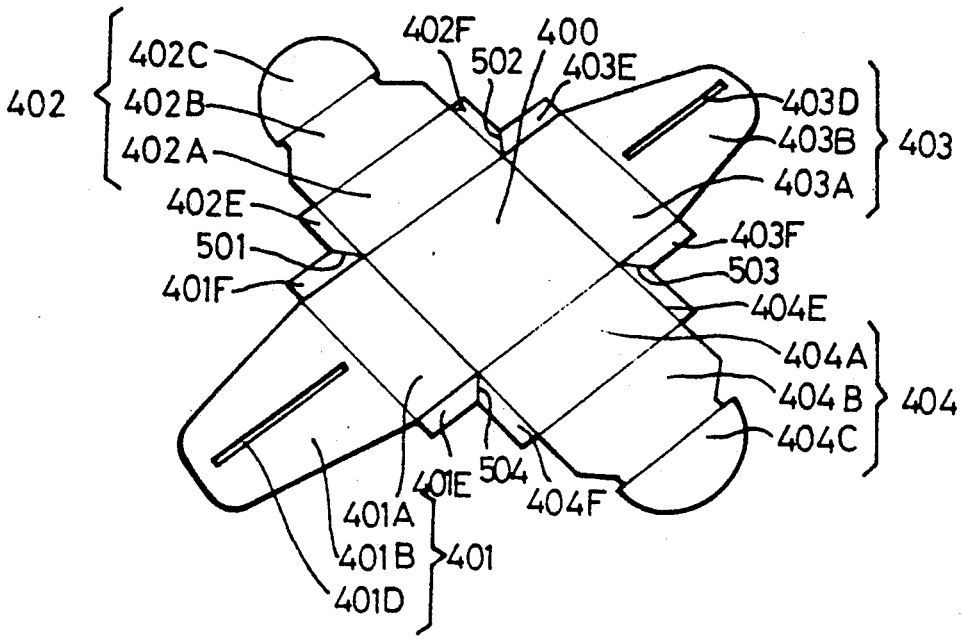
FIG. 8 is a complete view of the blank of a box with a square cross section.

FIGS. 7 and 8 correspond to a blank for forming a rectangular or square box. The different components of the blank are similar to those in FIG. 3 and the reference numbers of homologous parts are the same but increased by 200.

The blank consists of a base 400 bordered by flaps 401, 402, 403, 404 each formed by a lower part (401A . . . 404A) and a tab (401B . . . 404B).

The tabs 401A, 403A are provided with a slot 401C, 403C and the tabs 402A, 404A end in tongues 402C, 404C.

The flaps 401 . . . 404 are bordered at the strengthening strips 401E, 401F; 402E; 402F; 403E, 403F, 404E, 404F connected by fold rods 501, 502, 503, 504.

The tongues 402C, 404C slide into slots 401C, 403C and act as handles.

As in the other embodiments, the strengthening strips connected to one another by fold lines provide the flaps with rigidity and resistance in the raised position when the box is closed.

It should be noted that the blank with the square base described above in connection with FIGS. 7 and 8 may also have a rectangular base similar to that of a square, or very elongate, for example to form a yule log box.

Figure 9:
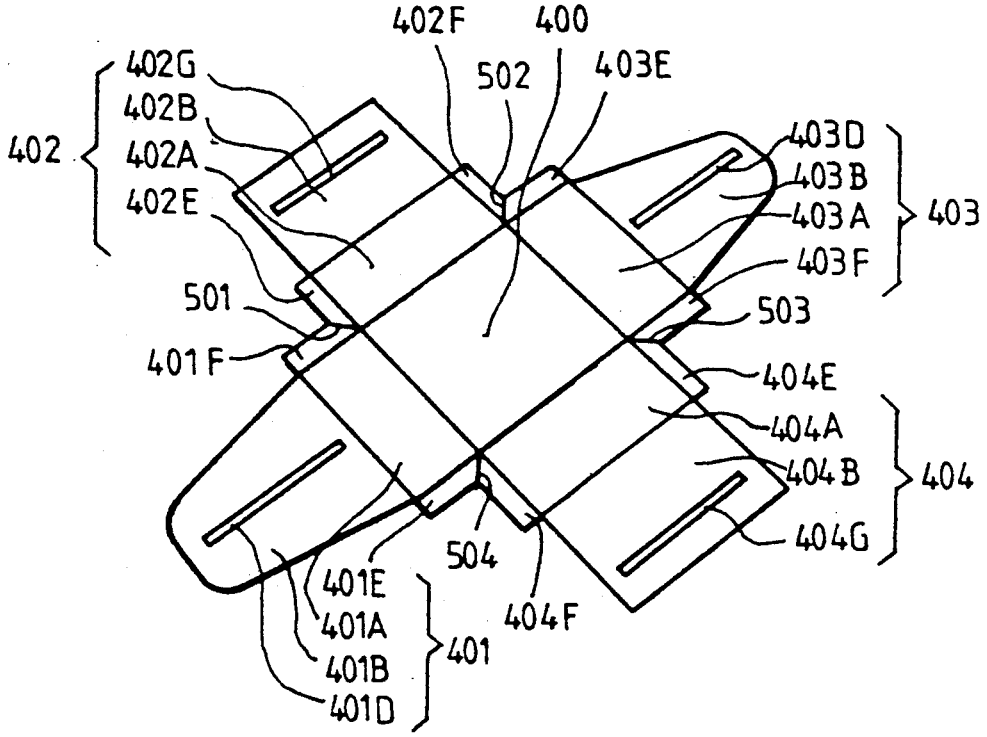
FIG. 9 is a variant of FIG. 8.

FIG. 9 shows a variant of FIG. 8, having a blank the flaps 402B, 404B of which do not end in tongues for retaining the closed position of the box.

On the contrary, the flaps 402B, 404B are each provided with a slot 402G, 404G which are parallel to and of the same dimensions as slots 401D, 403D on the flaps 401B, 403B.

The other components of the blank in FIG. 9 are the same as those in FIG. 8 and bear the same reference numbers.

Figure 10:
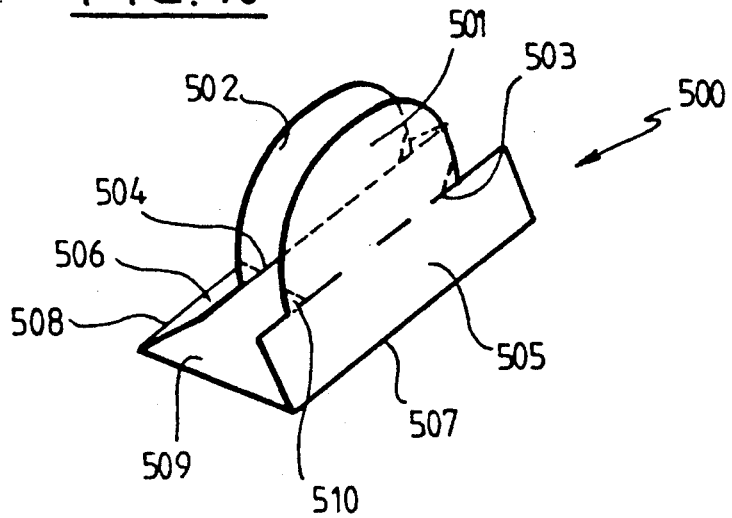
FIG. 10 shows a double tongue for closing the box in FIG. 9.

The box in FIG. 9 is closed by a double tongue 500 illustrated in FIG. 10.

This double tongue 500 is a cut-out part formed by two tongues 501, 502, which are rounded for example and the lower part of each of which is connected to a flap 505, 506 by a fold line 503, 504. These flaps are themselves connected to the center part 509 by fold lines 507, 508.

The double tongue folded as shown in perspective in FIG. 10 slides, for example, in the superimposed slots of three of the tabs on the box in FIG. 9. Then the tongues 501, 502 are held on the exterior and the slot of the fourth tab is attached.

It should be noted that at the fold lines 503, 504 the tongues may have notches 510 to retain and fasten the tabs in the closed position.

I claim:

1. A box for holding and carrying a product such as pastries, cakes or other products requiring an opened up display, the box being formed from a blank having a prefolded configuration and a folded configuration to form said box, said blank comprising:

a. a base having a plurality of peripheral edge portions;

b. a plurality of flaps, each comprising:

i. a lower flap portion having a lower hinge portion connected to a related peripheral edge portion at a related hinge line, and arranged so that each of said lower flap portions can be moved upwardly about said hinge line to form a related one of side portions of said box, each lower flap portion also having an upper edge portion and two side edge portions;

ii. an upper tab portion having a connecting edge portion having a hinge connection to the upper edge portion of a related lower flap portion along a tab hinge line, with the tab portions being arranged to be folded about said tab hinge lines to form a top portion of said box;

c. a plurality of pairs of first and second adjacent strengthening strips having i. first and second hinge connections, respectively, to adjacent side edge portions of adjacent lower flap portions;

ii. first and second outer edge portions which in the prefolded configuration diverge from one another in an outward direction;

iii. first and second inner juncture portions which extend inwardly from inner lower ends of said first and second outer edge portions to lower ends of said adjacent side edge portions, with said first and second inner juncture portions connecting to one another along a juncture fold line;

d. said blank being arranged so that in being moved from said prefolded configuration to said folded configuration, as said lower flap portions are moved upwardly toward one another, each pair of first and second strengthening strips rotate about respective first and second hinge connections inwardly, and also rotate relative to one another about their related juncture fold line so that in the folded configuration, the first and second strips of each pair are positioned against one another and project inwardly toward an interior of said box only to a distance equal to a width dimension of the first and second strips.

2. The box as recited in claim 1, wherein the base is a regular polygon.

3. The box as recited in claim 1, wherein each of said tab portions is provided with connecting means for cooperating with homologous connecting means of other tab portions.

4. The box as recited in claim 3, wherein said connecting means are provided by at least one of said tab portions having a slot, and at least one other of said tab portions having an end tongue portion which can enter said slot of the one tab portion.

5. The box as recited in claim 4, wherein said tongue portion is provided with cut-outs so as to form laterally extending shoulders for holding the tab portion in position in the slot.

6. The box as recited in claim 1, wherein each tab portion is provided with a slot, with these slots being positioned so that with the tab portions being folded over to form a top of said box, said slots are in aligned relationship to receive a separate tongue member for locking said tongue portions one to another.

7. The box as recited in claim 1, wherein said base is a regular polygon other than a square, and at least one of said tab portions has a slot to receive a tongue portion of another tab portion with the slot being aligned toward a center of said base when the blank is in the prefolded configuration, and said tongue portion is joined to its related tab portion along a hinge line which is slanted relative to an alignment axis which extends radially from a center of said base in the prefold condition outwardly through said flap, whereby with the box in the folded configuration, said tongue portion can be aligned at a desired position relative to lower flap portions which form the side portions in the box in the folded configuration.

8. The box as recited in claim 7, wherein there is a plurality of slots formed in respective tab portions.

9. The box as recited in claim 8, wherein there is a plurality of tongue portions formed on respective tab portions.

10. The box as recited in claim 7, wherein there is a plurality of tongue portions formed on respective tab portions.

11. A box for holding and carrying a product such as pastries, cakes or other products requiring an opened up display, the box being formed from a blank having a prefolded configuration and a folded configuration to form said box, said blank comprising:

a. a base having a plurality of peripheral edge portions, where said base is a regular polygon other than a square;

b. a plurality of flaps, each comprising:

i. a lower flap portion having a lower hinge portion connected to a related peripheral edge portion at a related hinge line, and arranged so that each of said lower flap portions can be moved upwardly about said hinge line to form a related one of side portions of said box, each lower flap portion also having an upper edge portion and two side edge portions;

ii. an upper tab portion having a connecting edge portion having a hinge connection to the upper edge portion of a related lower flap portion along a tab hinge line, with the tab portions being arranged to be folded about said tab hinge lines to form a top portion of said box;

c. a plurality of pairs of first and second adjacent strengthening strips having first and second hinge connections, respectively, to adjacent side edge portions of adjacent lower flap portions, first and second juncture portions which extend inwardly to lower ends of said adjacent side edge portions, with said first and second inner juncture portions connecting to one another along a juncture fold line;

d. said blank being arranged so that in being moved from said prefolded configuration to said folded configuration, as said lower flap portions are moved upwardly toward one another, each pair of first and second strengthening strips rotate about respective first and second hinge connections inwardly, and also rotate relative to one another about their related juncture fold line so that in the folded configuration, the first and second strips of each pair are positioned against one another and project inwardly toward an interior of said box;

e. at least one of said tab portions having a slot to receive a tongue portion of another tab portion with the slot being aligned toward a center of said base when the blank is in the prefolded configuration, and said tongue portion is joined to its related tab portion along a hinge line which is slanted relative to an alignment axis which extends radially from a center of said base in the prefold condition outwardly through said flap, whereby with the box in the folded configuration, said tongue portion can be aligned at a desired position relative to lower flap portions which form the side portions of the box in the folded configuration.

12. The box as recited in claim 11, wherein there is a plurality of slots formed in respective tab portions.

13. The box as recited in claim 12, wherein there is a plurality of tongue portions formed on respective tab portions.

14. The box as recited in claim 11, wherein there is a plurality of tongue portions formed on respective tab portions.

* * * * *